United States Patent [19]

Pivont et al.

[11] 3,956,948

[45] May 18, 1976

[54] SHARPENING MACHINE FOR ROOT-CUTTER KNIVES

[75] Inventors: Michel André Pivont; Paul Alphonse Vicca, both of Tienen, Belgium

[73] Assignee: Raffinerie Tirlemontoise, Brussels, Belgium

[22] Filed: Apr. 14, 1975

[21] Appl. No.: 567,964

[30] Foreign Application Priority Data

Apr. 12, 1974 Belgium ..... 813688

[52] U.S. Cl. ..... 76/89.1; 90/14; 90/21 R

[51] Int. Cl.[2] ..... B21K 11/02

[58] Field of Search ..... 76/82, 89.1; 90/14, 90/21 R; 51/5 B, 96, 108 R, 215 UE

[56] References Cited

UNITED STATES PATENTS

| | | | |
|---|---|---|---|
| 2,069,140 | 1/1937 | Freas et al. | 76/82 |
| 3,128,644 | 4/1964 | Forsyth et al. | 76/89.1 |
| 3,153,305 | 10/1964 | Burt | 51/108 R X |

*Primary Examiner*—Al Lawrence Smith
*Assistant Examiner*—Nicholas P. Godici
*Attorney, Agent, or Firm*—Sughrue, Rothwell, Mion, Zinn & Macpeak

[57] ABSTRACT

A sharpening machine for root-cutter knives is disclosed. The machine generally comprises a jaw device for supporting a knife to be sharpened, the knife having a serrated edge which is to be sharpened. A magazine for the holding the knives to be sharpened is utilized along with a device for feeding the knives singly from the magazine to the jaw device. Both rough sharpening and fine sharpening devices are utilized, each of the devices having a milling device utilizing a rotating milling cutter. The jaw device is rotatably mounted on a shaft in parallel relationship with the rotating shaft of the milling cutter, and apparatus is provided to periodically swing the jaw device about the shaft between a position where the knife engages the milling cutter and a rest position where no engagement takes place. Additionally, the device utilizes a mechanism for stepwise movement of the milling cutter relative to the jaw device, as well as a cam shaft for controlling the swinging of the jaw device.

7 Claims, 8 Drawing Figures

SHARPENING MACHINE FOR ROOT-CUTTER KNIVES

BACKGROUND OF THE INVENTION

This invention relates to a sharpening machine for root-cutter knives, which comprises a jaw device for supporting a knife to be sharpened, said knife having a serrated edge to be sharpened, a magazine for knives to be sharpened, a device for feeding singly a knife from the magazine to the jaw device, a rough-sharpening device and a finesharpening device for the knives, said sharpening devices each comprising a milling device having a rotary milling cutter, the jaw device being rotatably mounted on a shaft in parallel relationship with the milling cutter rotating shaft, and means being provided to periodically swing the jaw device about the shaft thereof between a position where the knife engages the milling cutter and a rest position where the knife does not engage the milling cutter, the machine comprising moreover a rack-and-rachet mechanism for stepwise movement of the milling cutter relative to the jaw device as well as a cam shaft for controlling the swinging of the jaw device and the rack device.

The root-cutter knives, also known as Koenigsfeld's knives, are comprised of a plate terminating in a corrugated or serrated cutting edge.

The sharpening of such knives comprises the following operations:

1. a dressing or milling of the cutting face which removes the remaining portion of the cutting edge obtained during the previous sharpening;
2. a first rough sharpening or breaking-down which cuts into the one knife serrated surface over a few millimeters to have said surface form a very acute angle with the other surface;
3. a second fine sharpening which cuts into the knife over about one millimeter to sharpen the knife;
4. a deburring which removes the small chips which remain attached to the knife.

Until recent times, said four operations have been performed on a separate machine; each machine had to be fed separately, the required manpower for the sharpening thus being rather large.

A machine has been proposed to perform the breaking-down and fine-sharpening operations on the knives. In said known machine, the worn knives, previously milled, are stored inside a magazine from which they are fed one by one to a first jaw device which is so arranged that the knive is moved stepwise in front of a breaking-down device; thereafter, the knife is released from the first jaw device and it is taken over by a second jaw device which moves again stepwise the knife in front of the milling cutter in the finesharpening device. Finally the knife is released and falls into a store for machined knives.

This invention has for object to provide a sharpening machine for root-cutter knives, which allows to perform the four operations required for the sharpening, which is compact, simple as regards the parts and movements, and in which each knife to be sharpened is arranged from start to finish of the operations, in one and the same jaw device.

For this purpose, the machine according to the invention comprises a horizontal conveyor on which are mounted a plurality of jaw devices, said conveyor having a plurality of stopping positions in each one of which a jaw device is arranged in front of the magazine and in front of each one of the sharpening devices, each sharpening device comprising a milling device which is slidingly mounted on the rotating shaft thereof and a lever block to which is associated the rack-and-rachet mechanism which is connected to the milling device and which comprises a member for pushing the jaw device to swing same from the non-engagement position thereof to the engagement position where the knife engages the milling cutter, and each jaw device comprising a fixed jaw rotatingly mounted about said swinging shaft and having a knife supporting plate, and a movable jaw frame integral with the fixed jaw and comprising a plunger for pushing the knife against the plate, slidingly arranged in the movable jaw frame, directed upwards and bearing at the top thereof a jack for operating said plunger, a return member being associated to said movable jaw frame to swing said device towards the rest position thereof, the knife-supporting plate bearing an ejector slide arranged in the path of said knife and a spring member for moving the slide along a direction which corresponds to the ejection of the knife from the jaw, the magazine comprising a knife-stacking area and a knife-pushing slide arranged at the stack bottom on the fixed jaw plate and operating against the ejector slide spring, and said horizontal conveyor bearing members for operating the jaw device jacks, so as to bring the jack in each jaw device to a position in which said jack causes the plunger to move away from the plate before said device being located in front of the magazine.

PRIOR ART

In U.S. Pat. No. 3,153,305 has for example been described a machine for sharpening household articles, which comprises a rotating table on which are arranged devices for clamping said articles, the table stopping in sequence in front of a plurality of work stations. Said sharpening machine is but partly similar to the present machine in that on the one hand there is no disclosure of automatic feeding and ejecting mechanisms for the articles and on the other hand the work stations and the articles stopped in front thereof do not require relative movements during the operation.

In French Pat. No. 789,917 there has further been disclosed a machine for sharpening root-cutter knives which comprises two separate sharpening stations having a fixed milling device and a jaw device which is swingably and slidingly mounted on a shaft in parallel relationship with the mill cutter shaft. Said machine does not have either automatic feeding and ejecting mechanisms for the knives in the jaw device; moreover, the swinging and feeding mechanisms for the jaw devices are very intricate and are not suitable for a machine according to the invention in which the jaw devices are mounted without translation movability on a conveyor.

SUMMARY OF THE INVENTION

In a preferred embodiment of the invention, between the magazine for the knives to be sharpened and the rough-sharpening device is arranged a device for grinding the knives to be sharpened and the conveyor stops in sequence in front of the magazine, the grinding device and each one of the sharpening devices.

BRIEF DESCRIPTION OF THE DRAWINGS

Other details and features of the invention will stand out from the description given below by way of non limitative example and with reference to the accompanying drawings, in which.

In the various figures, the same reference numerals pertain to similar elements.

DESCRIPTION OF THE PPEFERRED EMBODIMENT

Figure 1:
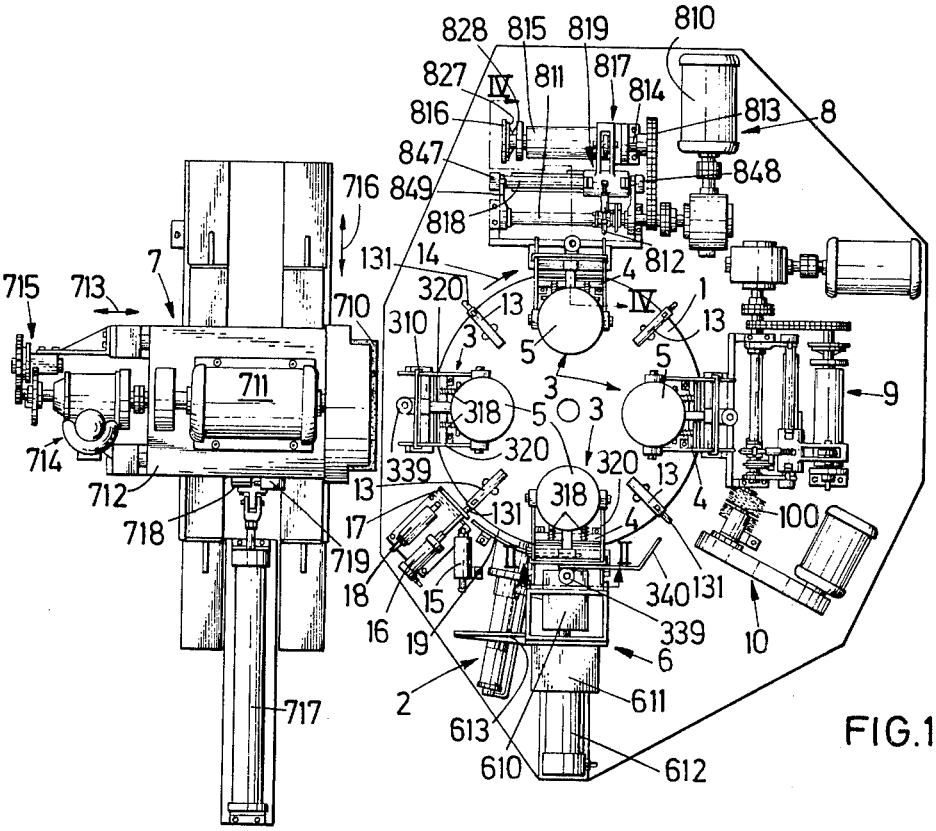
FIG. 1 is a diagrammatic plan view of a sharpening machine for root-cutter knives according to the invention.

The sharpening machine for root-cutter knives, shown in the figures, comprises a conveying table rotating about a vertical axis with four stopping positions. The table is driven by an air or hydraulic device 2, in a way well known per se. The conveying table 1 bears four jaw devices 3 spaced by 90° from one another, which are each designed to bear one knife to be sharpened. The jaw devices 3 will be further described hereinafter. There should be stated here that each jaw device is so mounted on the conveying table 1 as to swing about a horizontal axis 4 and it comprises a fixed jaw and a movable jaw operated by a hydraulic or air jack 5.

Each jaw device 3 stops in sequence in front of a magazine 6 for knives to be sharpened, in front of a grinding-wheel 7, in front of a rough sharpening device called hereinafter breaking-down device 8, and in front of a fine sharpening device 9.

Between the fine sharpening device 9 and the magazine 6 is arranged a station 10 for deburring the sharpened knives, before ejecting same from the jaw device, said ejecting being made during the movement of each jaw from the fine sharpening device 9 to the magazine 6 as further described hereinafter.

Figure 2:
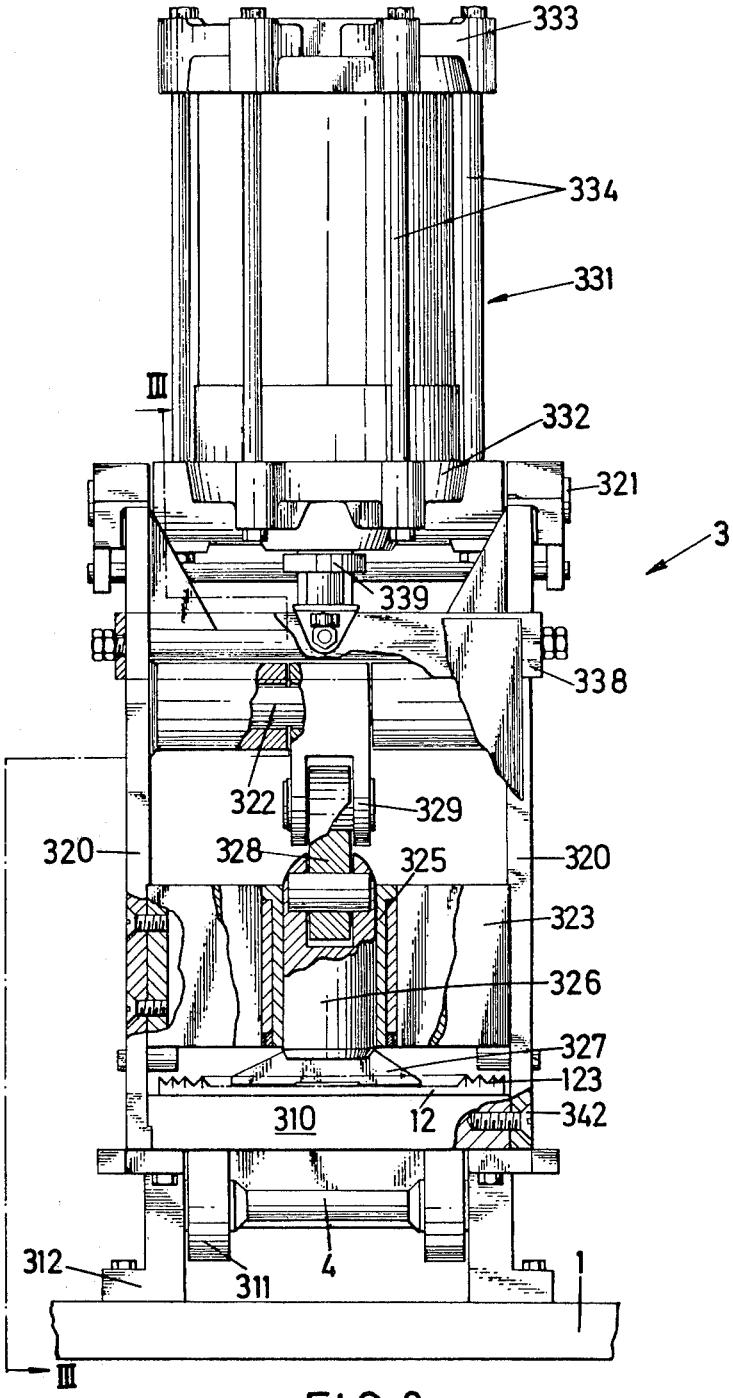
FIG. 2 is a front view along line II—II in FIG. 1, with parts broken away, of the jaw device provided with a knife.
Figure 3:
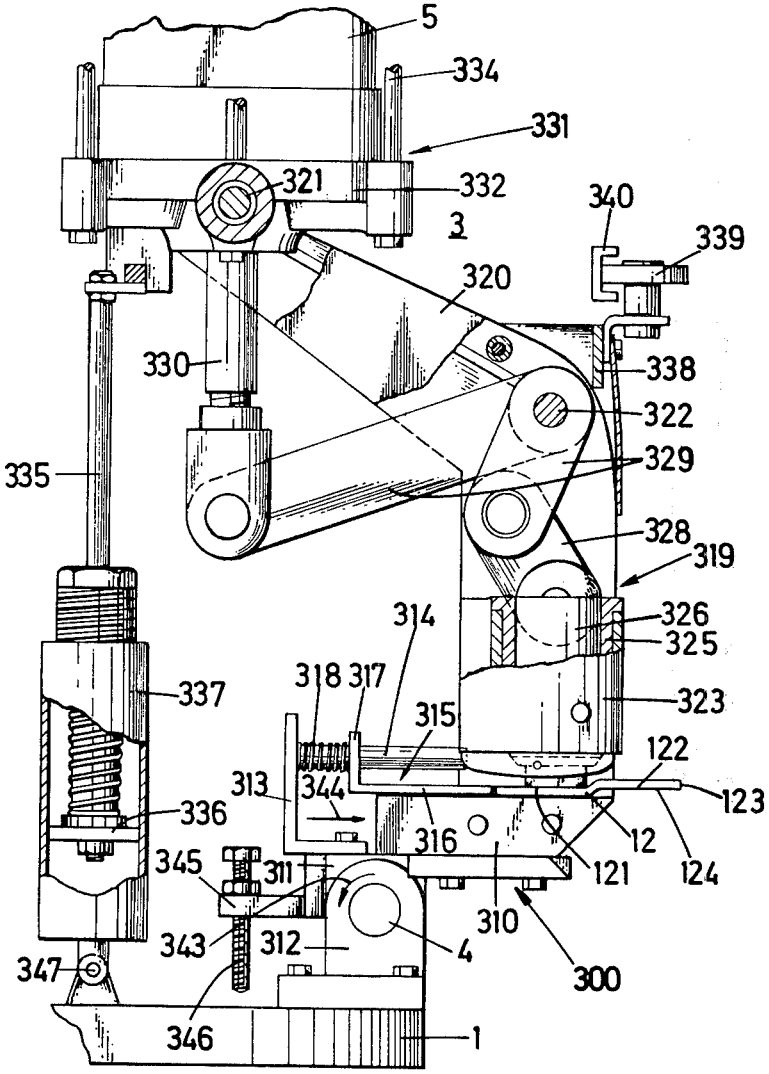
FIG. 3 is an elevation view partly in section along line III—III in FIG. 2.

One jaw device 3 has been shown with more details in FIGS. 2 and 3.

The jaw device has for its purpose to support one and the same knife to be sharpened 12 during each one of the grinding, breaking-down, sharpening and deburring operations.

Those knives for which the machine according to the invention is designed are root-cutter knives, notably for cutting down beets into cossettes, such as the knives known as Koenigsfeld's knives. They are generally of rectangular shape and they have a back part 121 which is clamped in the jaw device 3 and a front part 122 displaced upwards which terminates in a serrated cutting edge 123. Said serrated edge is precisely the edge to be sharpened.

The jaw device 3 comprises a fixed jaw 300 having a support plate 310 for feeding the knives 12. The plate 310 is made fast to the top of a pair of vertical lugs 311 swingably mounted about the shaft 4 which is supported inside bearings 312 which are made fast to the table 1.

In back of plate 310, on the lugs 311 is mounted an angle-iron 313 from which projects a pair of rods 314. A slide 315 with a bottom 316 and a back 317 bears on plate 310. Through slide back 317 pass said rods 314. On each rod 314 a spring 318 is mounted between angle-iron 313 and slide back 317.

To the angle-iron 313 is made fast a L-shaped fitting 345 which is directed downwards and on which is mounted a stop 346.

The jaw device 3 comprises a movable jaw 319. Said movable jaw 319 comprises a frame integral with the fixed jaw 300 and inside which moves a movable jaw member. The frame is biased backwards by a return member for swinging the jaw device 3 about the shaft 4 thereof in the direction shown by arrow 343, down to a so-called rest position, for a purpose which will be further defined hereinafter. Said rest position is defined by stop 346.

The movable jaw frame comprises in the example shown, a pair of spaced vertical bent arms 320 which are braced at the top end by a first rod 321, in the centre by a second rod 322 and at the lowermost end by a block 323. At the bottom thereof the arms 319 are made fast to plate 310 by means of screws 342. The block 323 is provided with a centre axial bore extending upwards, inside which is fastened a bushing 325 for slidingly receiving a plunger 326 to the lowermost part of which is made fast a pad 327. At the top end thereof the plunger 326 is hinged to the lowermost end of a link 328 joined to a two-arm lever 329 which is rotatably mounted about shaft 322. On that side opposite link 328, said lever is connected to the lowermost part of a rod 330 of jack 5. Said jack 5 is arranged inside a casing 331 mounted on the movable jaw frame. Said casing 331 is comprised of a lower platen 332, a top platen 333 and bracing rods 334. The lower platen 332 of casing 331 is swingably mounted about shaft 321.

At the back, the movable jaw frame is biased towards table 1 by a rod 335 extending upwards which is joined at the bottom with a piston 336 mounted inside a cylinder 337 open to atmosphere on either side of the piston. Cylinder 337 is hingedly mounted in 347 on table 1. A spring 345 bearing on piston 336 and the top end of cylinder 337 tries to depress piston 336 towards the lower end of said cylinder. Under the action of the weight of jack 5 and return spring 345, the jaw device 3 normally rotates about shaft 4 along the direction shown by arrow 343 down to the rest position thereof as determined by stop 346 and shown in solid lines in FIG. 4.

At the front of the movable jaw frame, a plate 338 is mounted between arms 320. Said plate bears a roller 339 which engages a rail which is fixedly mounted adjacent magazine 6. Said rail is so located that when jaw device 3 is stopped in front of magazine 6, the jaw device swings from the piston shown in solid lines in FIG. 4 to the position shown in FIG. 2, in such a way that the fixed jaw 310 be suitably located relative to the magazine 6, that with plate 310 horizontal.

The position shown in FIGS. 2 and 3 corresponds to that condition where jack 5 is pressurized and where rod 330 thereof lies in the lowermost position thereof. Under such conditions, the plunger 326 of the jaw device lies also in the lowermost position thereof which corresponds to the clamping of a knife 12 against plate 310. When jack 5 moves to the rest position thereof, the rod 330 goes up which causes lever 329 to swing and plunger 326 to go up. If a knife was previously clamped, it is now ejected under the action of springs 318 which push slide 315 back along the direction of arrow 344.

It is to be noted that knife 12 is so arranged in jaw device 3 as to have the side 124 to be sharpened facing downwards.

Reference will again be made to FIG. 1. The rotating conveying table 1 bears four valves 13 for controlling the supply of air pressure to jacks 5. Valves 13 are displaced by about 45° along the rotation direction of said table as shown by arrow 14 relative to the corresponding jack 5. Valves 13 comprise an operating rod 131 which is normally extended relative to the valve and which as it engages a cam 19 adjacent magazine 6, is pushed back inside the valve to move same from the condition where pressurized air is supplied to jack 5 to the opposite condition.

Inside magazine 6 the worn knives 12 are stacked on a plate 610. A push-rod 611 driven by a jack 612 pushes by each operation of jack 612, triggered by the stopping of rotating table 1, a knife over plate 310 of the jaw device 3 which is then located in front of magazine 6.

As it enters jaw device 3, the knife 12 as already mentioned, pushes slide 315 back and thus compress the springs 318 which will be used to eject said knife after sharpening thereof.

A stop 613 moves together with the rod of jack 612 and operates an electric contact 15 when said rod reaches the end of the travel corresponding to the feeding of one knife to the jaw device. Said electric contact 15 controls the retracting of the rod of a jack 16. Said jack bears a movable push-rod 17 which lies in extension of cam 19 and which as it retracts together with jack 16 towards that position shown in dot and dash lines, releases the valve 13 that controls the jack 5 of the jaw device located in front of magazine 6. As soon as valve 13 is released from the engagement with push-rod 17, pressurized air is again supplied to jack 5 and the plunger 326 of the movable jaw 319 of jaw device 3 closes on knife 12.

As the retracting ends, the push-rod 17 operates an electric contact 18 which allows the rotating table 1 to rotate. To jack 16 is associated a time relay which is operated by contact 15 and the purpose of which is to return push-rod 17 to the position shown in solid lines in FIG. 1 before that valve 13 following the valve which has just been released, reaches a position level with jack 16.

After a rotation over 90°, the conveying table stops and the jaw device 3 which has just received a knife to be sharpened lies in front of the grinding device 7. Said grinding device 7 comprises as usual a grinding wheel 710 which is constantly driven by a motor 711. The grinding wheel 710 and the motor 711 thereof are part of a bed 712 which is movable along the direction shown by arrow 713 under the action of a motor unit 714 and a control unit 715 which also programs a plurality of runs of an alternating cross-wise motion of bed 712 along the direction shown by arrow 716. The cross-wise movement is performed by a jack 717.

When the grinding operation has been completed, a push-rod 718 integral with bed 712 operates an electric contact 719 which allows the table 1 to rotate.

After a further rotation over 90°, the conveying table 1 stops and the jaw device 3 bearing the ground knife lies in front of the rough sharpening device.

Said device essentially comprises a milling cutter 812, a meshanism 819 for stepwise feeding the milling cutter 812 in front of knife 12 and a mechanism for periodically engaging said knife with the milling cutter 812.

As a rule and as shown in FIG. 1, the breaking-down machine 8 comprises a motor-reducer unit 810 for driving a fluted shaft 811 on which is slidingly mounted the milling cutter 812 which is rotated by said shaft 811. Through a chain drive 813, the motor-reductor unit 810 drives a secondary shaft 814 to which is made fast a first lengthwise cam 815 and a second cam 816 which is mounted at the end of shaft 814.

The sharpening device 8 comprises a two-armed lever block 817, a front arm 810 and a back arm 824 extending on either side of a bushing 861 which is slidingly mounted on a shaft 818 in parallel relationship with shafts 811 and 814 and lying between said shafts. Shaft 181 comprises the swinging axes for the lever block 817.

Lever block 187 slides stepwise on shaft 818 under the action of the feeding mechanism 819 driven by the cam 816, as further described hereinafter. During said motion, lever block 817 takes the milling cutter 812 along by means of a fork 860 supported by the front arm 820 of lever block 817, in such a way that the milling cutter stops each time in front of a tooth to be sharpened of knife 12.

Figure 7:
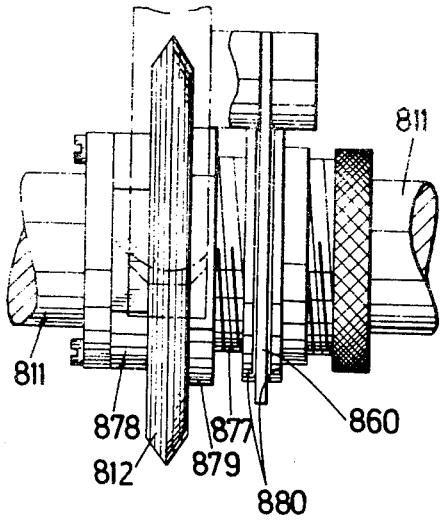
FIG. 7 is a plan view on a larger scale of a detail of the milling cutter mounting.

In FIG. 7 the details of the milling device have been shown. The milling cutter 812 is made fast to a threaded bushing 877 by means of two nuts 878, 879. Two other nuts 880, 881 forming a pair of collars between which fits the fork 860, are also screwed on the bushing 877. Said assembly allows to replace easily the milling cutter 812 and to locate the milling device relative to the fork 860.

Figure 4:
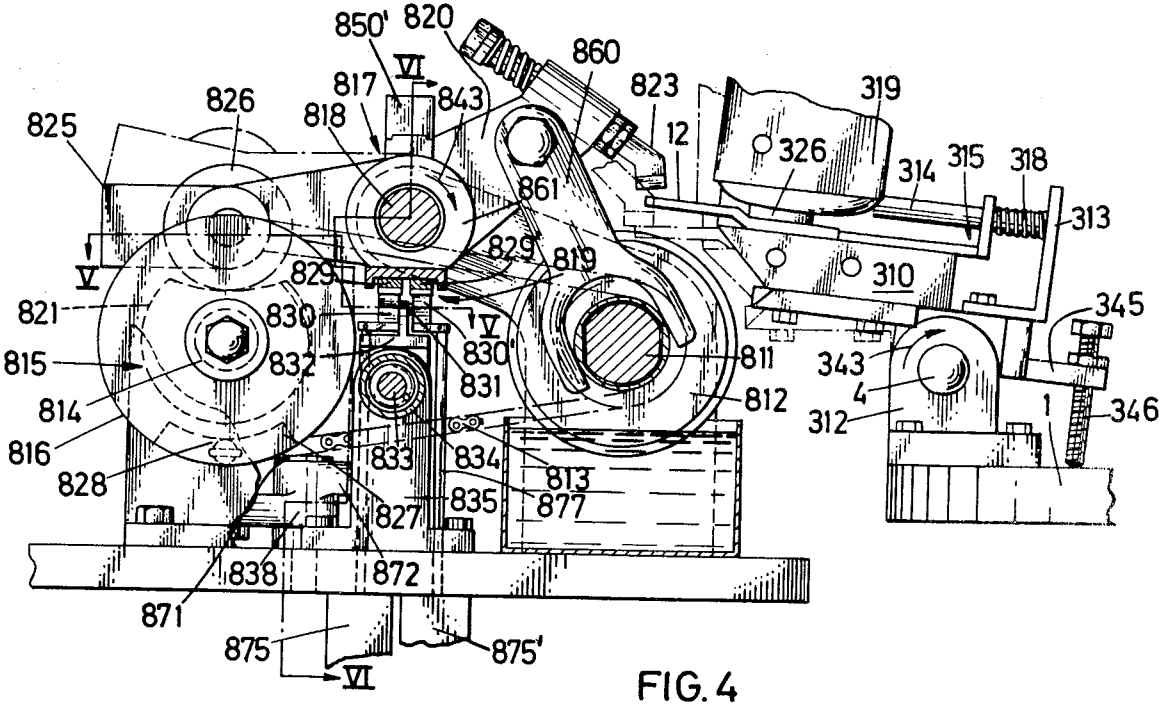
FIG. 4 is a section view with parts broken away, along line IV—IV in FIG. 1, of the rough sharpening device.

As shown more clearly in FIG. 4, the lengthwise cam 815 has a large-diameter portion 821 which extends over the major part of the circumference thereof and a small-diameter portion 822. The front arm 820 of the lever block 817 is provided at the front end thereof located above the area of a knife 12 supported by the jaw device 3, with a finger 823 bearing on said knife. The back arm 824 of the lever block 817 terminates in a counterweight 825. The arm 824 bears a roller 826 which is constantly applied under the action of counterweight 825, against the periphery of the lengthwise cam 815. In this way the lengthwise cam 815 results when roller 826 lies over the large-diameter portion 821, in swinging of the lever block 817 about shaft 818 in such a way that the finger 823 presses against knife 12 and engages same with the milling cutter as shown in dot and dash lines in FIG. 4.

Figure 6:
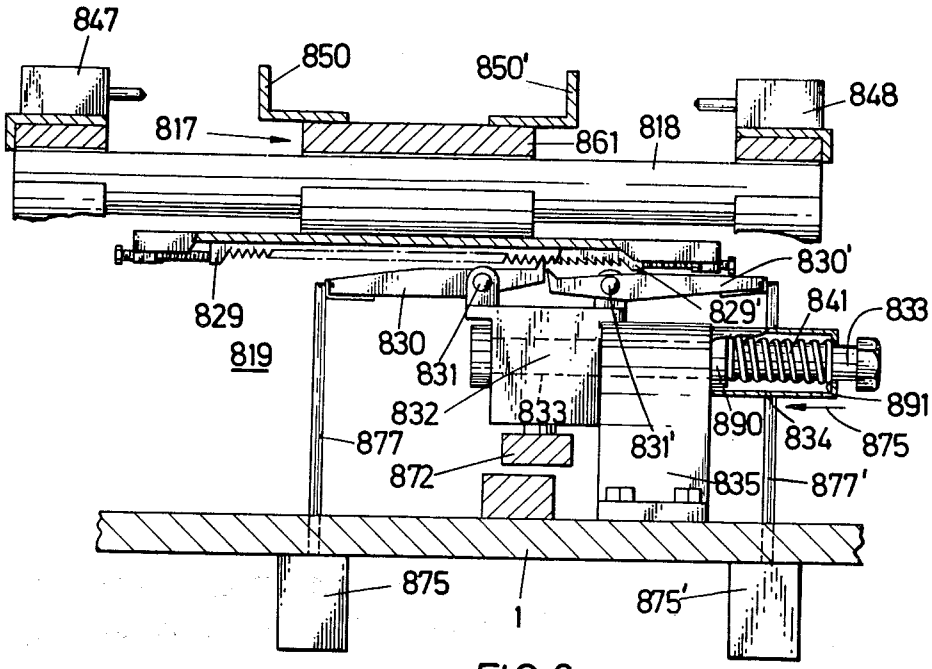
FIGS. 5 and 6 are part section views along lines V—V and VI—VI, respectively, in FIG. 4, of the milling cutter driving mechanism.
Figure 5:
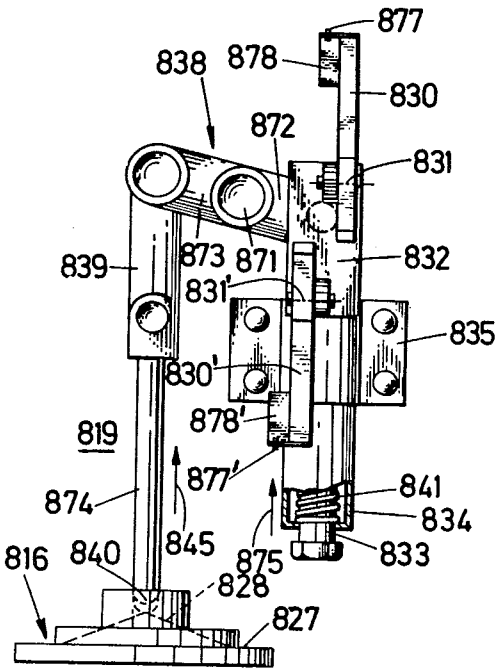

The stepwise feeding mechanism 819 comprises a pair of racks 829, 829' made fast underneath bushing 861 of the lever block 817. Both racks are parallel to one another and to shaft 818 and said racks lie on behind the other as shown in FIG. 6. The rack teeth have a pitch equal to the tooth pitch of knife 12 and the slanting of the teeth of rack 829 is opposite to the slanting of the teeth of rack 829' as clearly shown in FIG. 6.

To each rack 829, 829' is associated a pawl 830, 830' hinged about a pivot 831, 831' supported by a bearing element 822 made fast to the upper arm 872 of a lever 838 which is so mounted as to swing about a vertical shaft 871 fastened to table 1. To the lower arm 873 of lever 838 is made fast a link 839 which is connected in turn to a rod 874 which is terminated by a roller 840 applied against the shaped edge of cam 816. To the pawl support element 832 is made fast a rod 833 which slides through a vertical bearing 835. To said bearing 835 is fastened a cylinder 834 through which also passes rod 833. Around said rod 833 is arranged a return spring 841 which bears in the one hand against a washer 890 made fast to said rod and on the other hand on the end 891 of said cylinder. Under the action of spring 841, the support element 832 is biased along the direction shown by arrow 875 which forces roller 840 to remain constantly applied against cam 816.

To each pawl 830, 830′ is associated an electro-magnet 876, 876′ mounted underneath rotating table 1. The movable leaf from each electro-magnet is connected to a vertical rod 877, 877′ that passes through table 1 and is joined to a shoe 878, 878′ provided on pawl 830, 830′. That electro-magnet which is energized moves the rod 877, 877′upwards over such a distance that pawl 830, 830′ swings from a position where it does engage the rack 829, 829′thereof to a position where it does not engage said rack. In FIG. 6 the pawl 830 has been shown engaging the corresponding rack, while the pawl 830′ is shown out of contact with the corresponding rack.

Finally the breaking-down device comprises a pair of end switches 847, 848 which are arranged level with the ends of racks 829, 829′ and which are each operated by a stop 850, 850′ arranged on bushing 861 of lever block 817.

The breaking-down device 8 works as follows:

When the conveying table 1 has performed the 90° rotation which corresponds to the movement of jaw device 3 bearing the ground knife from the position thereof in front of grinding device 7 to the position in front of breaking-down device 8, the jaw device 3 lies in the swung-back position thereof shown in solid lines in FIG. 4. The lever block 817 then lies in the rightmost or leftmost position thereof, the rightmost position being shown in FIG. 1; the roller 826 of the lever block lies in the recess 822 of lengthwise cam 815. When table 1 stops, the motor-reductor unit 810 starts operating and rotates the milling cutter 812 as well as cam shaft 814. Each 360° revolution cycle of cam shaft 814 then comprises two phases:

The first phase corresponds to the engagement of the roller with the large-diameter portion 821 of lengthwise cam 815 and to the contact of stop 840 with the flat portion of surface 827 of the end cam 816. During said first phase, the lever block 817 swings along the direction of arrow 843 and by means of the finger 823 thereof bearing on knife 12, takes along the jaw device 3 which swings about shaft 4 thereof in such a way that the knife engages the cutting circumference of milling cutter 812. This position has been shown in dot and dash lines in FIG. 4.

At the moment where roller 826 drops in recess 822 of the lengthwise cam 815, the second cycle phase begins. At this moment, the lever device swings backwards and releases the jaw device which returns to the position shown in solid lines in FIG. 4, that is the position thereof where the knife 12 does no more lie against the milling cutter 812. At that time, the V-shaped boss 828 of end cam 816 forces roller 826 and rod 874 to perform a movement along the direction of arrow 845, which causes the pawlbearing element 832 and pawl 830 to move in the opposite direction, against the action of spring 841. Pawl 830 drives during said movement that rack 829 with which it was engaged. It is then lever block 817 and consequently milling cutter 812 which moves from right to left on the respective shafts 818 and 811 thereof and this over a distance equal to one pitch interval of the teeth of knife 12. As soon as roller 840 has gone over the top of boss 828 of cam 816, spring 841 returns the pawl support element 832 towards the rest position, along the direction of arrow 875. During such movement the pawl 830 swings about the axis 831 thereof to locate itself in the following tooth of the rack 829 thereof. As soon as this rack movement has ended, the described cycle starts all over again.

When all the teeth of knife 12 have been subjected to the action of the milling cutter 812, the lever block 817 lies adjacent that side facing the end cam 816 of lengthwise cam 815; in this function, the stop 850′ operates the end contact 847. Said contact 847 has two functions: on the one hand the contact triggers the rotation of the table 1 over 90° to bring the following jaw device 3 in front of the breaking-down device; on the other hand the contact cuts off electro-magnet 875 and energizes electro-magnet 875′ so as to disable pawl 830 and enable the working of pawl 830′.

As soon as table 1 stops, the above-described cycle starts to repeat itself under the control of cams 815 and 816. However the action of pawl 830′ on rack 829′ results in moving the lever block 817 and thus the milling cutter 812 from left to right. During this phase of work of the device, the movement of roller 840 over the rise of the V-shaped boss of cam 816 which results in moving pawl 830′ along the direction opposite to the direction of arrow 875, and causes the pawl to pass from that tooth in which it was located at the start of the cycle under consideration to the following tooth. During the return of said roller towards the boss bottom and the movement of the pawl support element along the direction of arrow 875 under the action of spring 841, the movement of the rack and thus of milling cutter 812 is performed.

The relative position of the pawls and the racks as shown in FIG. 6 does not correspond to the position shown in FIG. 1. Said position has been selected to show more clearly the action of both pawls.

After a rotation over 90°, the conveying table 1 stops and the jaw device 3 bearing that knife which has precisely been broken-down lies in front of the fine sharpening device 9. Said device 9 is completely similar in design and operation to the breaking-down device 8, the only difference lies in the revolution speed of the milling cutter and the position relative to the knife. Indeed the sharpening having to be made over a shorter distance from the knife edge, about 1 millimeter, the milling cutter axis lies farther away from the knife edge then the breaking-down machine and moreover the milling cutter rotates faster.

Figure 8:
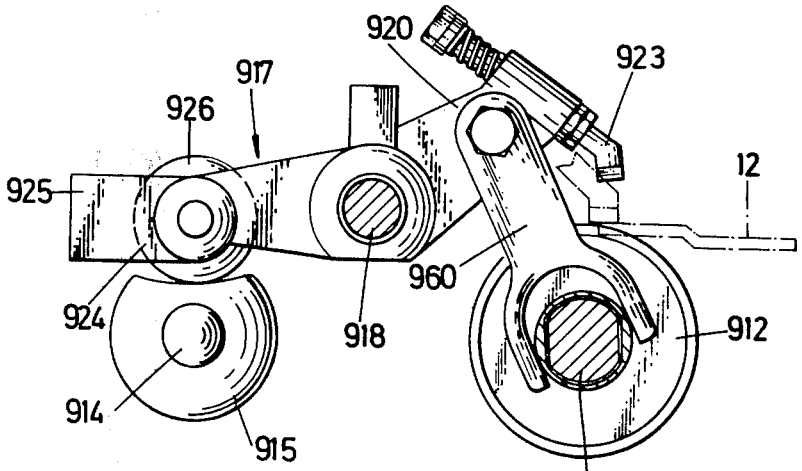
FIG. 8 is a part elevation view of the sharpening device.

In FIG. 8 has been shown a diagrammatic part elevation view which corresponds to FIG. 4; the same elements bear the same reference but to the first digit 8 has been substituted the digit 9.

When the jaw device 3 moves after the sharpening and during the movement of table 1 between station 9 and magazine 6, the knife 12 passes in the deburring station 10, between a pair of rotating brushes 100, as shown in FIG. 1.

During the movement between the position in front of the fine sharpening device 9 and the knife magazine 6, the valve 13 of that jaw device 3 which bears the sharpened knife engages the arcuate cam 19 which follows the outer edge of the rotating table 1 said cam 19 begins approximately at the half-width of magazine 6 and extends up to the push-rod 17 which then lies directly in extension thereof. The valve 13 when it engages cam 19, reverses the air circuit for jack 5 in such a way that piston rod 330 of jaw device 3 goes down and causes plunger 326 of said jaw device 3 to go up. Under the action of springs 318, the knife 12 is ejected from jaw device 3 immediately before stopping of the table 1. When said table has stopped, the jaw device 3 lies again in front of magazine 6 to receive a new knife to be sharpened.

It must be understood that the invention is in no way limited to the above embodiments and that many changes can be brought therein within the scope of the invention as defined by the appended claims.

For instance to the rotating conveying table 1 could be substituted another type of conveyor for the jaw devices 3. The grinding device could be dispensed with and the grinding could be performed on a separate machine. Finally to the air jack could be substituted a hydraulic jack the rod of which would be directly connected to plunger 326 of the jaw device.

We claim:

1. Sharpening machine for root-cutter knives, which comprises a jaw device for supporting a knife to be sharpened, said knife having a serrated edge to be sharpened, a magazine for knives to be sharpened, a device for feeding singly a knife from the magazine to the jaw device, a rough-sharpening device and a fine-sharpening device for the knives, said sharpening devices each comprising a milling device having a rotary milling cutter, the jaw device being rotatably mounted on a shaft in parallel relationship with the milling cutter rotating shaft, and means being provided to periodically swing the jaw device about the shaft thereof between a position where the knife engages the milling cutter and a rest position where the knife does not engage the milling cutter, the machine comprising moreover a rack-and-rachet mechanism for stepwise movement of the milling cutter relative to the jaw device as well as a cam shaft for controlling the swinging of the jaw device and the rack device, the machine further comprising a horizontal conveyor on which are mounted a plurality of jaw devices, said conveyor having a plurality of stopping positions in each one of which a jaw device is arranged in front of the magazine and in front of each one of the sharpening devices, each sharpening device comprising a milling device which is slidingly mounted on the rotating shaft thereof and a lever block to which is associated the rack-and-rachet mechanism which is connected to the milling device and which comprises a member for pushing the jaw device to swing same from the non-engagement position thereof to the engagement position where the knife engages the milling cutter, and each jaw device comprising a fixed jaw rotatingly mounted about said swinging shaft and having a knife supporting plate, and a movable jaw frame integral with the fixed jaw and comprising a plunger for pushing the knife against the plate slidingly arranged in the movable jaw frame directed upwards and bearing at the top thereof a jack for operating said plunger a return member being associated to said movable jack frame to swing said device towards the rest position thereof, the knife-supporting plate bearing an ejector slide arranged in the path of said knife and a spring member for moving the slide along a direction which corresponds to the ejection of the knife from the jaw, the magazine comprising a knife-stacking area and a knife-pushing slide arranged at the stack bottom on the fixed jaw plate and operating against the ejector slide spring, and said horizontal conveyor bearing members for operating the jaw device jacks, so as to bring the jack in each jaw device to a position in which said jack causes the plunger to move away from the plate before said device being located in front of the magazine.

2. Sharpening machine as claimed in claim 1, in which the movable jaw frame bears a member to be engaged inside a guide made fast relative to the conveyor, said member causing the jaw device to swing from the rest position to a position where the fixed jaw plate is located in a plane in parallel relationship with the movement direction of the magazine push slide.

3. Sharpening machine as claimed in claim 1, in which to each jaw device jack is associated a control valve mounted on the conveyor some distance away from the jack and in front thereof when considering the conveyor movement direction, said valve comprising a control rod lying normally in a projecting position corresponding to that jack condition where said plunger clamps a knife against said plate, said rod lying in the path of a cam member located along the conveyor path in the area of the supply magazine, the cam acting on the valve to bring said jack in the condition where the plunger moves away from said plate, the machine further comprising a movable push-rod which can lie in a first position in the extension of said cam and in a second position away from said first position, said push-rod being located where said valve stops when the plate is stopped in that position where the jaw device controlled by said valve lies in front of the knife magazine, and the magazine push slide comprises a stop for operating an element controlling the slide retracting when a knife has been fed to the jaw device.

4. Sharpening machine as claimed in claim 1, in which in the sharpening devices the lever block is slidingly and rotatingly mounted on a lever shaft in parallel relationship with the milling device shaft and a cam shaft is provided with a first cam for swinging the lever block and a second cam for operating the rack-and-pawl mechanism, said rack-and-pawl mechanism comprising a pair of side-by-side racks in parallel relationship with one another mounted on the lever block, said racks having teeth slanting respectively in opposite directions, as well as a pair of pawls supported by a movable support element moving with an alternating motion in parallel relationship with the lever shaft under the action of the second cam and of return means, a member disengaging the pawl from the rack thereof being associated with each rack-pawl unit and operating alternatively so as to move the lever block and the milling cutter stepwise and alternately in one direction along the shafts thereof and then in the opposite direction.

5. Sharpening machine as claimed in claim 4, in which the lever block is provided with a front arm facing the jaw device and bearing the push member, and a back arm of heavier weight than the front arm, said back arm bearing a roller applied by the rack arm weight against the swinging cam.

6. Sharpening machine as claimed in claim 4, in which the push member for the lever block is comprised of a depending finger projecting from the lever block front arm, said finger extending over the knife so as to abut the projecting portion relative to the jaw device during the swinging of said lever block.

7. Sharpening machine as claimed in claim 1, in which between the magazine for the knives to be sharpened and the rough-sharpening device is arranged a device for grinding the knives to be sharpened and the conveyor stops in sequence in front of the magazine, the grinding device and each one of the sharpening devices.

* * * * *